United States Patent [19]

Romero

[11] Patent Number: 4,972,976

[45] Date of Patent: Nov. 27, 1990

[54] DISPENSING UNIT FOR BOTTLED WATER

[76] Inventor: Robert A. Romero, 3036 Alameda de las Pulgas, San Mateo, Calif. 94403

[21] Appl. No.: 354,701

[22] Filed: May 23, 1989

[51] Int. Cl.[5] ..... B67D 5/06

[52] U.S. Cl. ..... 222/185; 222/523; 141/353; 141/357

[58] Field of Search ..... 141/351, 353, 354, 355, 141/357; 222/185, 522, 523, 255

[56] References Cited

U.S. PATENT DOCUMENTS

| | | | |
|---|---|---|---|
| 1,538,483 | 5/1925 | Grantham | 141/363 |
| 1,768,091 | 6/1930 | Adair | 222/185 |
| 2,811,272 | 10/1957 | Lamor | 141/363 |
| 4,356,848 | 11/1982 | Spies | 141/362 |
| 4,717,051 | 1/1988 | Leclerc | 222/545 |
| 4,874,023 | 10/1989 | Ulm | 141/349 |

FOREIGN PATENT DOCUMENTS

| | | | |
|---|---|---|---|
| 2077886 | 12/1981 | United Kingdom | 141/360 |

*Primary Examiner*—Andres Kashnikow
*Assistant Examiner*—W. T. Waffner
*Attorney, Agent, or Firm*—Phillips, Moore, Lempio & Finley

[57] ABSTRACT

A dispensing unit is adapted to be attached over a dispensing spout or neck of a bottle containing a liquid, such as water, therein. The dispensing unit includes a shroud having an extension adapted to be inserted into a receptacle defined on a standard dispenser stand. A cylindrical passage is defined through the shroud and is sized to receive the spout of the bottle therein. In one embodiment of the invention, a valve member functions to close communications of water from the spout, through the passage and into the receptacle of the dispenser stand when the bottle is inverted and the spout and the extension of the shroud are initially placed within the receptacle. When the bottle is lowered the shroud engages the dispenser to communicate water from the bottle into the receptacle of the dispenser for consumption purposes. In a second embodiment of this invention, the spout of the bottle has a cap secured over its open end and a piercing member is secured within the shroud to pierce the cap and communicate water from the bottle and into the receptacle when the bottle is lowered and the shroud contacts the dispenser stand.

17 Claims, 4 Drawing Sheets

DISPENSING UNIT FOR BOTTLED WATER

TECHNICAL FIELD

This invention relates generally to a dispensing unit for bottled water and more particularly to a dispensing unit adapted to be attached to the spout or neck of a bottle to facilitate mounting of the bottle on a dispenser stand.

BACKGROUND OF THE INVENTION

The popularity of bottled water for home and office use has dictated the need for a dispensing unit to facilitate inversion and mounting of the bottle on a dispenser stand without loss of water. It is common practice to cover the open spout or neck of bottled water, usually of the five gallon variety, with a plastic cap that is stripped-off prior to inversion and mounting of the bottle on the dispenser stand. A reoccurring problem with this standard procedure is the loss of water from the bottle and the wetting of surrounding areas, as well as the wetting of the person placing the bottle on the dispenser stand.

SUMMARY OF THE INVENTION

An object of this invention is to provide a dispensing unit for bottled water that overcomes the above, briefly described problems.

The dispensing unit is adapted to be attached over a dispensing spout or neck of a bottle containing a liquid, such as water, therein. The dispensing unit comprises a shroud sized for insertion into a receptacle of a standard dispenser stand with the shroud having a passage defined therethrough and sized for reception of the spout of the bottle therein. Means are provided for closing communication of liquid from the spout, through the passage and into the receptacle when the bottle is inverted and the spout and shroud are initially placed within the receptacle. Such means further provides for communicating liquid from the spout, through the passage and into the receptacle in response to lowering of the shroud into contact with the dispenser stand.

In one embodiment of this invention, such means comprises a valve element secured within the shroud to provide a stopper adapted to be positioned in a sealed position within the spout of the bottle when the bottle is initially inverted and to open when the bottle is lowered relative to the shroud.

In a second embodiment of this invention, such means comprises a piercing member secured within the shroud to pierce a cap secured on the open end of the spout of the bottle when the bottle is lowered relative to the spout.

BRIEF DESCRIPTION OF THE DRAWINGS

Other objects and advantages of this invention will become apparent from the following description and accompanying drawings wherein.

DETAILED DESCRIPTION

Figure 1:
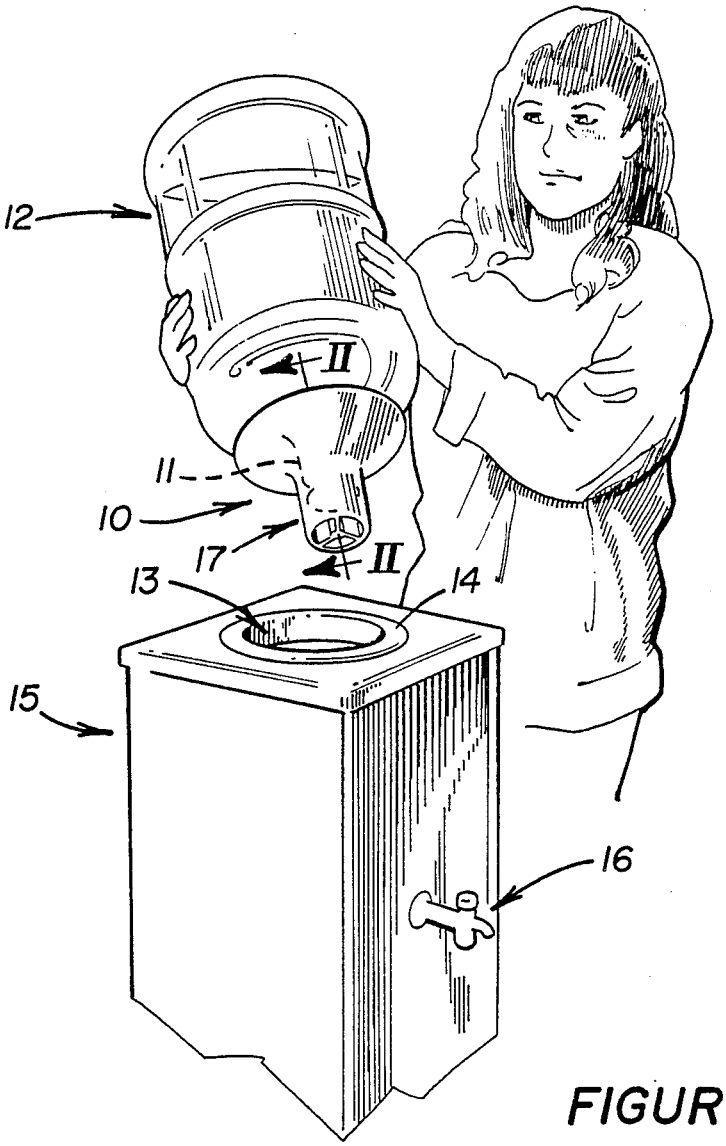
FIG. 1 illustrates attachment of a dispensing unit of this invention to a bottle containing water, prior to the mounting of the bottle and attached dispensing unit on a conventional dispenser stand.

FIG. 1 illustrates a dispensing unit 10 attached over a dispensing spout 11 of a five gallon plastic or glass bottle 12. The bottle contains a liquid, such as distilled water, adapted to have its spout mounted within a receptacle 13 defined within an annular plastic collar 14 of a common dispenser stand 15. The dispenser stand further includes a standard mini-faucet 16 adapted to dispense the water in a conventional manner.

Figure 2:
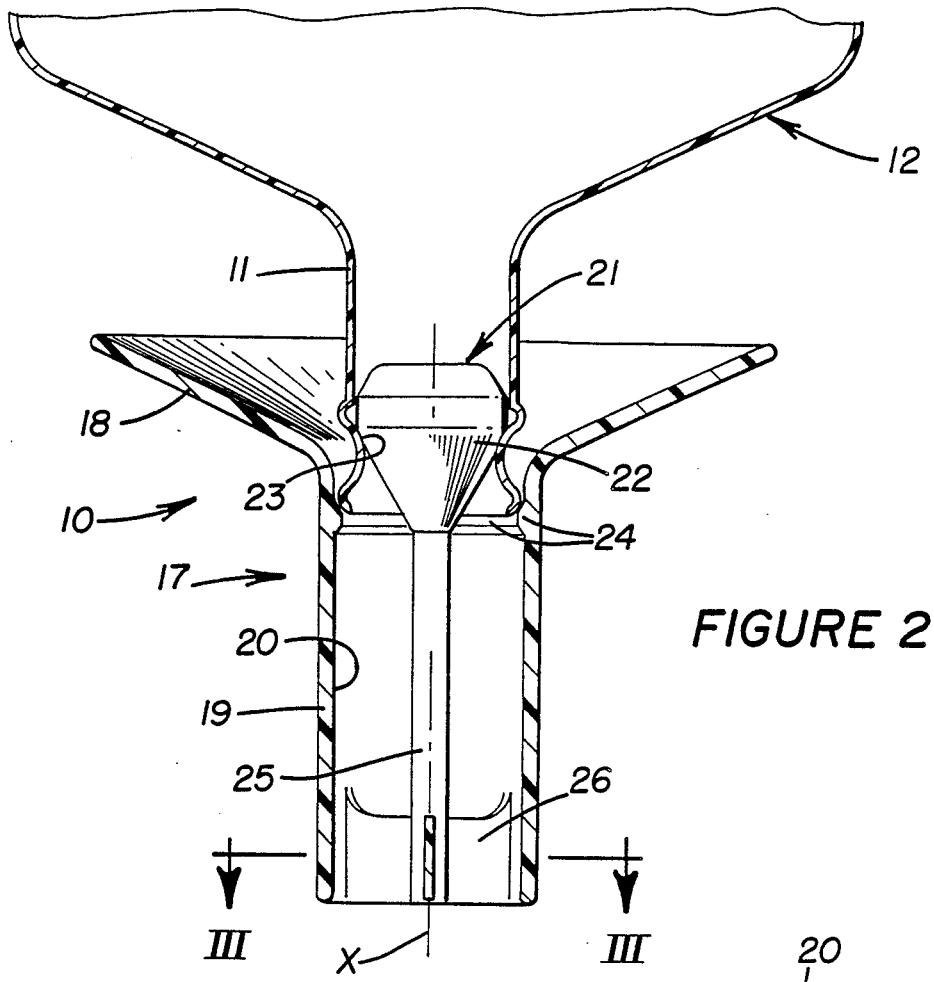
FIG. 2 is an enlarged sectional view, taken in a direction of arrows II—II in FIG. 1.

Referring to FIG. 2, dispensing unit 10 comprises a shroud 17 having a conically shaped flange 18 and a tubular extension 19 extending downwardly from the flange. Tubular extension 19 of the shroud is sized for insertion into receptacle 13. A substantially cylindrical flow passage 20 is defined through the extension and sized for close and telescopic reception of bottle spout 11 therein (FIG. 4).

As further shown in FIG. 2, the dispensing unit includes water flow control means for initially closing communication of water from spout 11, through flow passage 20 and into receptacle 13 of dispenser stand 15 when a standard plastic closure cap (e.g., cap 27 in FIG. 5) is removed and replaced by the dispensing unit. In particular, when the dispensing unit is attached over the open-end of spout 11 and the bottle in inverted to place spout 11 and extension 19 within receptacle 13, a valve member or stopper 21 will close such communication. As shown in FIG. 4, water will thereafter communicate from spout 11, through flow passage 20 and into receptacle 13 in response to lowering of shroud 17 into contact with collar 14 of the dispenser stand and lowering of bottle 12 relative to the shroud.

Figure 3:
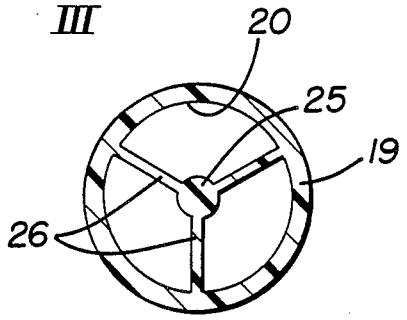
FIG. 3 is a cross sectional view through the dispensing unit, taken in a direction of arrows III—III in FIG. 2.
Figure 4:
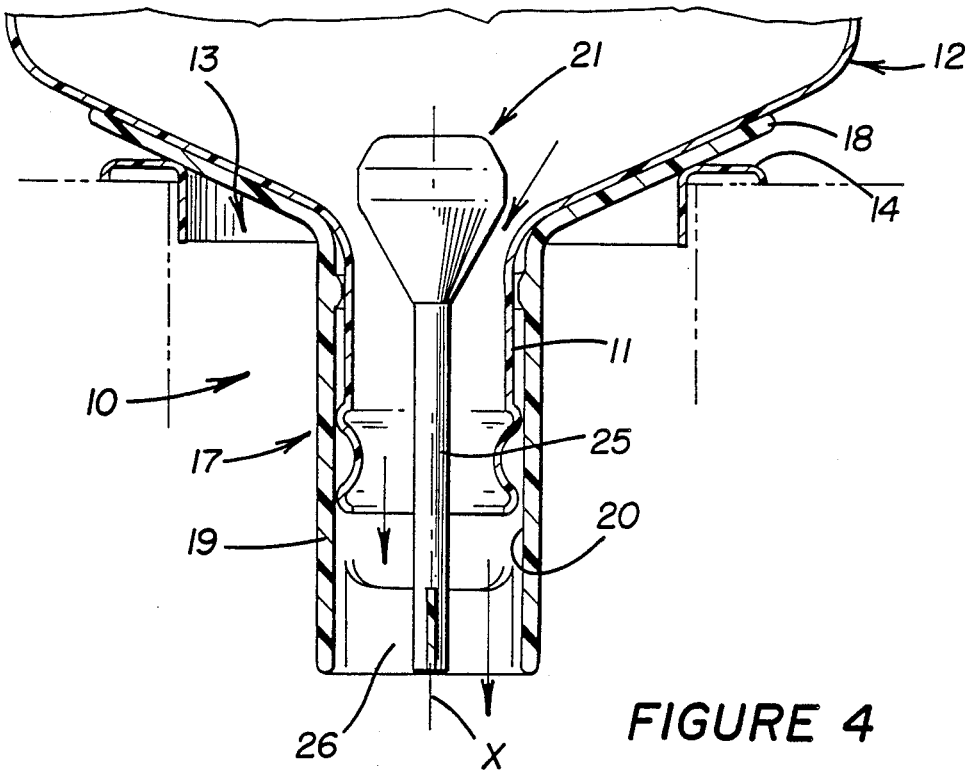
FIG. 4 is a view similar to FIG. 2, but illustrates mounting of the dispensing unit and bottle on the dispenser stand and lowering of the bottle relative to the dispensing unit to communicate water from the bottle to the dispenser stand.

As shown in FIGS. 2–4, valve member 21 has a frustro-conically shaped or tapered seat 22 defined thereon by outer surfaces that diverge downwardly towards the central longitudinal axis X of the dispensing unit and a lower or distal end of extension 19 thereof. When the valve member is in its closed position illustrated in FIG. 2, seat 22 will engage an annular seat 23 defined within spout 11 of bottle 12. The valve member is composed of a sufficiently soft and resilient plastic material that will compress slightly to provide a positive static seal between annular seats 22 and 23 with the water in the bottle providing a sufficient downward force to aid in retaining the valve member in its closed position.

An annular bead 24 is preferably formed within a proximal end of extension 19 to provide stop means engagable with the end of bottle spout 11 to precisely position valve member 21 in its closed and sealed position within the spout, as illustrated in FIG. 2. The valve member, normally having a maximum outside diameter slightly greater than seat 23, is composed of a sufficiently deformable plastic and elastomeric material to permit it to be compressed when inserted into spout 11 and automatically expand into its illustrated closing position therein. The valve member is at least partially disposed in passage 20 and is preferably formed on a proximal end of a centrally disposed stem 25 with the distal end of the stem being secured within extension 19 by a plurality of circumferentially spaced and radially extending struts 26 (FIG. 3).

In use, dispensing unit is attached to spout 11 of bottle 12 in the manner described above (FIG. 2) with the consumer then inverting the bottle to lower it over receptacle 13, as illustrated in FIG. 1. As shown in FIG. 4, insertion of extension 19 of the dispensing unit into receptacle 13 will engage flange 18 with collar 14. Further lowering of the bottle, relative to shroud 17 of the dispensing unit, will function to move valve member 21 upwardly relative to the bottle to thus freely communicate water from spout 11, through flow passage 20 and into receptacle 13 of dispenser stand 15. After the water has been fully expended from the bottle by the consumer, the dispensing unit can be removed from the bottle and reattached to a new bottle in the manner described above.

Figure 5:
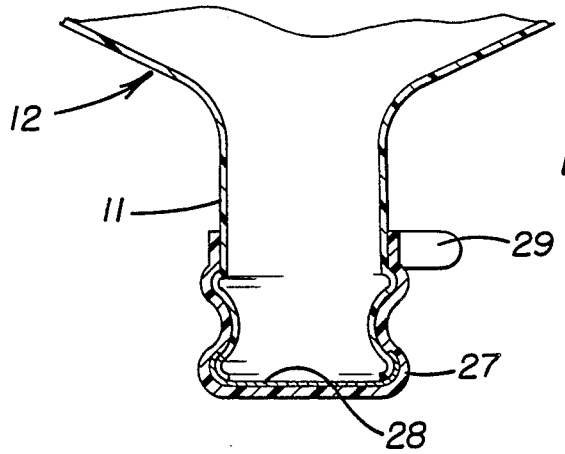
FIG. 5 illustrates the neck or spout of a bottle having a pair of caps attached on the open end thereof.

FIG. 5 illustrates standard plastic cap 27 detachably secured over a second metal or plastic sanitary cap 28, both closing the open end of neck 11 of the bottle. Cap 27, is normally solely used to cover the open end of the bottle illustrated in FIGS. 1–4, and includes a tear-tab 29 adapted to strip-off cap 27 from the neck of the bottle.

Figure 6:
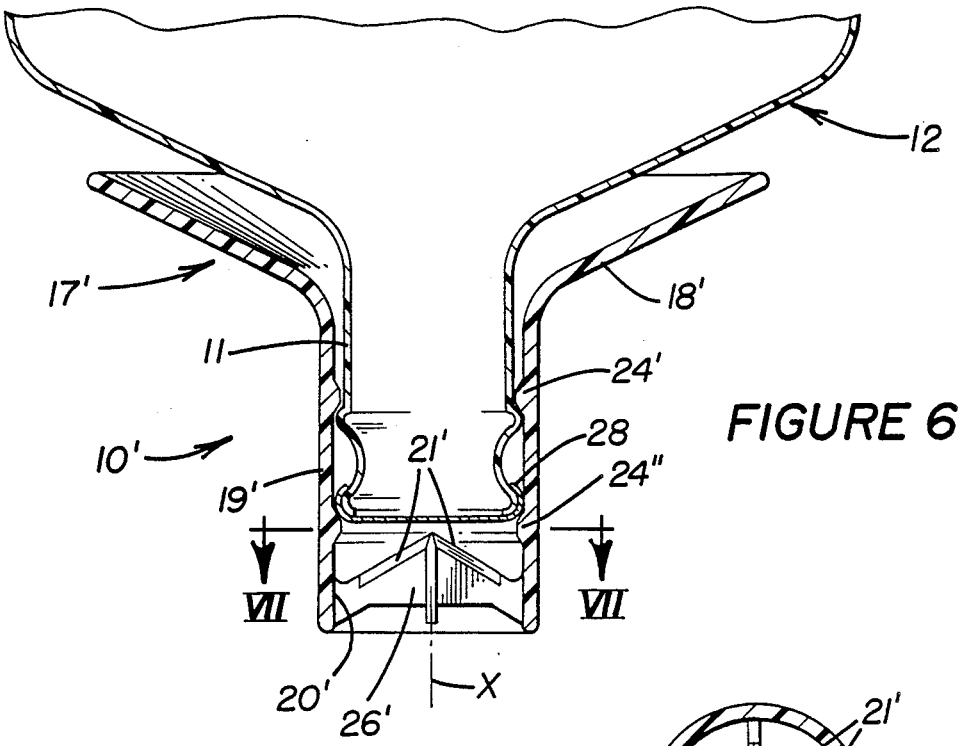
FIG. 6 is a view similar to FIG. 2, but illustrates a modification of the dispensing unit and it's attachment on the spout of the bottle illustrated in FIG. 5.
Figure 7:
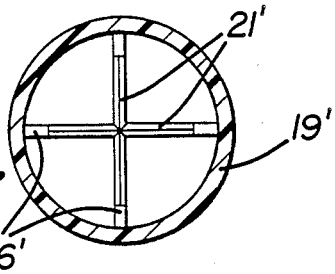
FIG. 7 is a sectional view, taken in the direction of arrows VII—VII in FIG. 6.

FIGS. 6 & 7 illustrate a modified dispensing unit 10' particularly adapted for use with the type of dual cap arrangement illustrated in FIG. 5. In particular, after cap 27 has been removed, dispensing unit 10' is attached to spout 11 of the bottle, as illustrated in FIG. 6. A pair of deformable and longitudinally spaced annular beads 24' and 24'' are formed internally on a tubular extension 19' of a shroud 17' to precisely position the spout or neck of the bottle within the extension.

A plurality of circumferentially spaced piercing members 21' (providing water flow "control means" along with cap 28) are formed integrally on a plurality of radially extending struts 26' to pierce cap 28. Such piercing occurs when a flange 18' of shroud 17' engages annular collar 14 (FIG. 4) and the bottle is lowered relative to the shroud from its position illustrated in FIG. 6. Thus, water from the bottle freely communicates by gravity through a flow passage 20; defined in extension 19' and into receptacle 13 in the manner described above. Both dispensing units 10 and 10' may be suitably molded as a one-piece construction in accordance with standard molding techniques.

I claim:

1. A dispensing unit for attachment over a dispensing spout of a bottle containing a liquid therein and insertion into a receptacle defined on a dispenser stand, said dispensing unit comprising shroud means engageable in unattached relationship with said bottle sized for partial insertion into said receptacle and having an at least substantially cylindrical passage means defined therethrough and sized for reception of said spout therein, and control means for closing communication of liquid from said spout, through said passage means and into said receptacle when said bottle is inverted and said spout and said shroud means are initially partially placed within said receptacle and including means formed integrally with and fixed relative to said shroud means for communicating liquid from said spout, through said passage means and into said receptacle in response to lowering of said shroud means into direct contact with said dispenser stand and continued lowering of said bottle relative to said shroud means.

2. The dispensing unit of claim 1 wherein said shroud means comprises a conically shaped flange and a tubular extension, defining said passage means therein, extending downwardly from said flange.

3. The dispensing unit of claim 2 wherein said control means comprises a valve member secured to said extension and being at least partially disposed within said passage means.

4. The dispensing unit of claim 3 wherein said valve member has a frustro-conically shaped seat defined thereon by outer surfaces that diverge downwardly towards a distal end said extension.

5. The dispensing unit of claim 3 further comprising stop means formed within a proximal end of said extension for engaging an end of said spout to position said valve member in a closed position within said spout for closing communication of liquid from said spout.

6. The dispensing unit of claim 3 wherein said valve member is formed of an elastomeric material having a maximum outside diameter greater than that of an annular seat defined within said spout.

7. The dispensing unit of claim 3 further comprising a stem centrally disposed within said passage means and wherein said valve member is secured to a proximal end of said stem.

8. The dispensing unit of claim 7 further comprising a plurality of circumferentially spaced and radially extending strut means for securing a distal end of said stem to said extension.

9. The dispensing unit of claim 2 wherein said control means comprises piercing means disposed within said passage means and secured to said extension for piercing a cap secured to an open end of said spout.

10. The dispensing unit of claim 9 wherein said piercing means comprises a plurality of circumferentially spaced piercing members.

11. The dispensing unit of claim 10 wherein said piercing members are formed integrally on a plurality of radially extending struts secured to said extension.

12. A dispensing unit attached over a dispensing spout of a bottle containing a liquid therein and adapted for insertion into a receptacle defined on a dispenser stand, said dispensing unit comprising a shroud having a conically shaped flange engageable in unattached relationship with said bottle and an extension sized for insertion into said receptacle a cylindrical passage defined through said extension and sized for reception of said spout therein, and valve means fixedly secured within said dispensing unit for closing communication of liquid from said spout, through said passage means and into said receptacle when said bottle is inverted and said spout and said shroud is initially partially placed within said receptacle and for automatically and continuously communicating liquid from said spout, through said passage means and into said receptacle in response to lowering of said shroud into direct contact with said dispenser stand and continued lowering of said bottle relative to said shroud.

13. The dispensing unit of claim 12 wherein said valve means comprises a deformable valve member secured within said extension and being at least partially disposed within said passage.

14. The dispensing unit of claim 13 wherein said valve member has a tapered seat defined thereon by outer surfaces that diverge downwardly towards a distal end of said extension.

15. The dispensing unit of claim 13 further comprising stop means formed within a proximal end of said extension for engaging an end of said spout to position said valve member in a closed position within said spout for closing communication of liquid from said spout.

16. The dispensing unit of claim 13 wherein said valve member is composed of an elastomeric material having a maximum outside diameter greater than that of an annular seat defined within said spout.

17. The dispensing unit of claim 13 further comprising a stem centrally disposed within said passage and having said valve member secured to a proximal end thereof and a plurality of circumferentially spaced and radially extending strut means for securing a distal end of said stem within said extension.

* * * * *